US009016267B1

(12) United States Patent
Tseng

(10) Patent No.: US 9,016,267 B1
(45) Date of Patent: Apr. 28, 2015

(54) PRESSURIZED GAS PROPELLED LINE LAUNCHING DEVICE

(71) Applicant: STARJET Technologies Co., Ltd, Jintan, Jiangsu (CN)

(72) Inventor: Jui-Fu Tseng, Yilan (TW)

(73) Assignee: STARJET Technologies Co., Ltd, Jintan (CN)

( * ) Notice: Subject to any disclaimer, the term of this patent is extended or adjusted under 35 U.S.C. 154(b) by 0 days.

(21) Appl. No.: 14/102,530

(22) Filed: Dec. 11, 2013

(51) Int. Cl.
*F41B 11/62* (2013.01)
*F41B 11/80* (2013.01)

(52) U.S. Cl.
CPC ..... *F41B 11/62* (2013.01); *F41B 11/80* (2013.01)

(58) Field of Classification Search
CPC ..... F41B 11/62; B63C 9/26
USPC ..... 89/1.34; 124/57, 71; 102/504; 441/85
See application file for complete search history.

(56) References Cited

U.S. PATENT DOCUMENTS

| | | | | | |
|---|---|---|---|---|---|
| 2,375,314 | A * | 5/1945 | Mills | 124/57 |
| 3,382,859 | A * | 5/1968 | Klingman | 124/74 |
| 3,505,926 | A * | 4/1970 | Johnson | 89/1.34 |
| 4,077,349 | A * | 3/1978 | Paul | 114/230.25 |
| 5,174,384 | A * | 12/1992 | Herman | 169/70 |
| RE36,965 | E * | 11/2000 | Salvemini | 441/85 |
| 8,857,305 | B1 * | 10/2014 | Tseng | 89/1.34 |
| 2002/0139239 | A1 * | 10/2002 | Vogl | 89/1.34 |
| 2006/0054152 | A1 * | 3/2006 | Ambrico | 124/71 |

* cited by examiner

*Primary Examiner* — Reginald Tillman, Jr.

(57) ABSTRACT

A line launching device is provided with a tube for receiving a projectile and including an externally threaded bottom and a cap put on the tube; a cylinder including a first externally threaded extension at one end, an internally threaded cup secured to the first externally threaded extension, a second externally threaded extension at an other end, and an internally threaded ring securing to both the second externally threaded extension and the externally threaded bottom; a hollow anchor fastened in one end of the tube; a hollow fin assembly in a bottom of the projectile and including slits on a housing, pivotal fins, and an internal biasing member biasing against the fins; and a rope having one end attached to the nose and an other end fastened in the anchor. The fins project out of the slits after the projectile being propelled out of the tube by pressurized gas.

1 Claim, 14 Drawing Sheets

PRESSURIZED GAS PROPELLED LINE LAUNCHING DEVICE

BACKGROUND OF THE INVENTION

1. Field of the Invention

The invention relates to rescue devices and more particularly to a pressurized gas propelled line launching device.

2. Description of Related Art

A conventional line launching device for launching a line spool is provided with a line thereon toward a target and includes a projectile such as a blank cartridge disposed into a marine flare pistol; a tubular housing with the line spool contained therein; a lead ballasted end cap; a bored fore end cap; and a space within the housing. One end of the line projects from the housing through the bored end cap and may be secured to a heavier line. Upon launching the device, the line continuously uncoils from the line spool until it reaches the point of impact. A secure line is then provided between the point of impact and the securing point.

While it has some utility, improvements in these products are desired, and these improvements are provided by the invention.

SUMMARY OF THE INVENTION

It is therefore one object of the invention to provide a pressurized gas propelled line launching device comprising a projectile comprising a nose; a tube for receiving the projectile and comprising an externally threaded bottom, a diaphragm member sealingly put on one end of the tube, and a cap releasably secured to one end of the tube; a cylinder comprising a first externally threaded extension at one end, an internally threaded cup secured to the first externally threaded extension, a second externally threaded extension at an other end, and an internally threaded ring securing to both the second externally threaded extension and the externally threaded bottom of the tube; a hollow anchor unit fastened in one end of the tube within the internally threaded ring; a hollow fin assembly disposed in a bottom of the projectile and comprising a diaphragm element secured to one end of the hollow anchor unit, a housing, a plurality of equally spaced slits on the housing, a plurality of spring actuated pivotal fins, and an internal biasing member biasing against the fins; a rope having one end attached to a bottom of the nose and an other end fastened in the anchor unit after passing through the projectile and the fin assembly; and a gas canister disposed in the cylinder; wherein the fins are capable of either projecting out of the slits after the projectile being propelled out of the tube by pressurized gas released out of the gas canister or retracting into the slits in an inoperative position.

The above and other objects, features and advantages of the invention will become apparent from the following detailed description taken with the accompanying drawings.

DETAILED DESCRIPTION OF THE INVENTION

Figure 1:
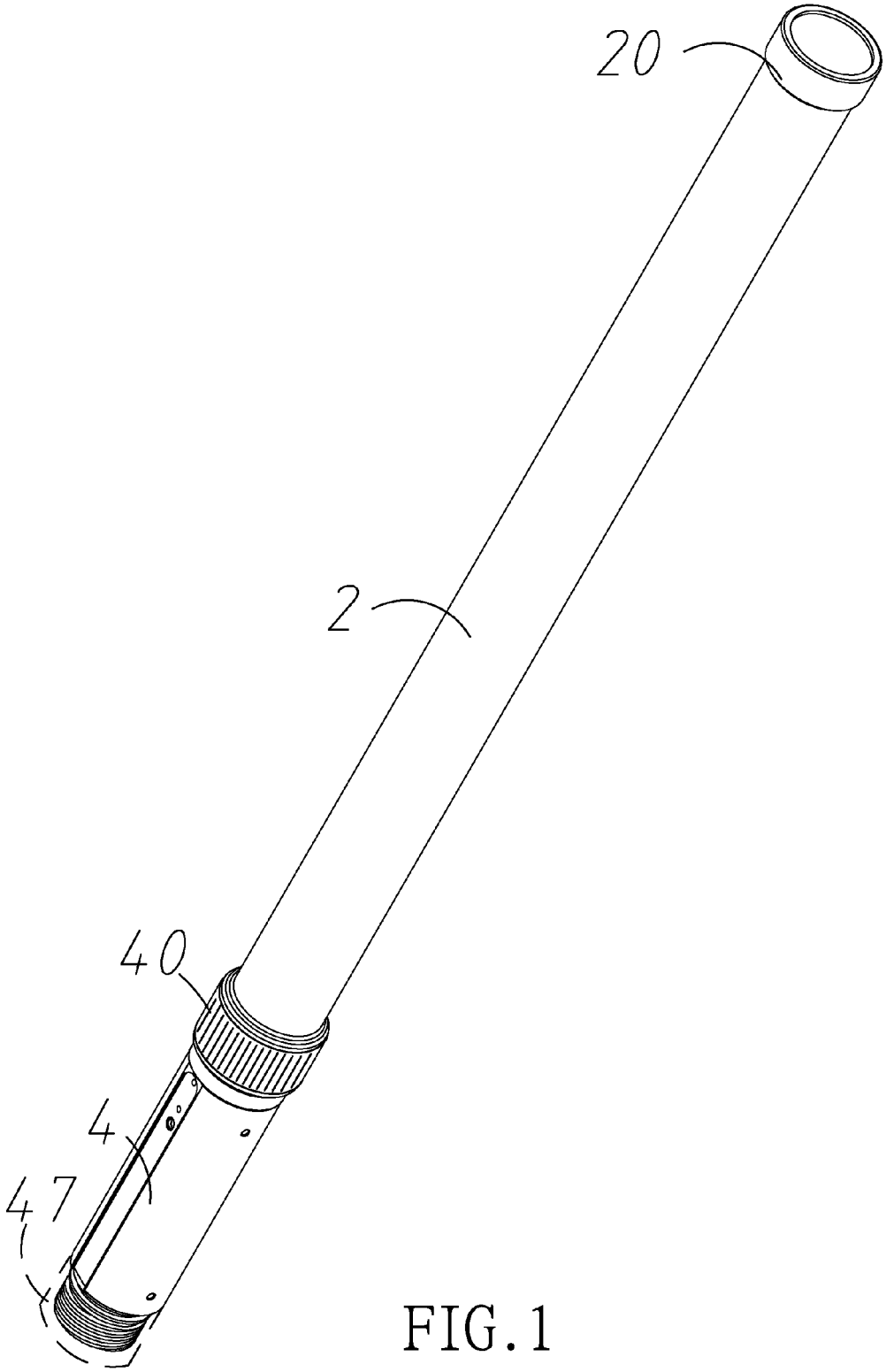
FIG. 1 is a perspective view of a line launching device according to the invention.
Figure 2:
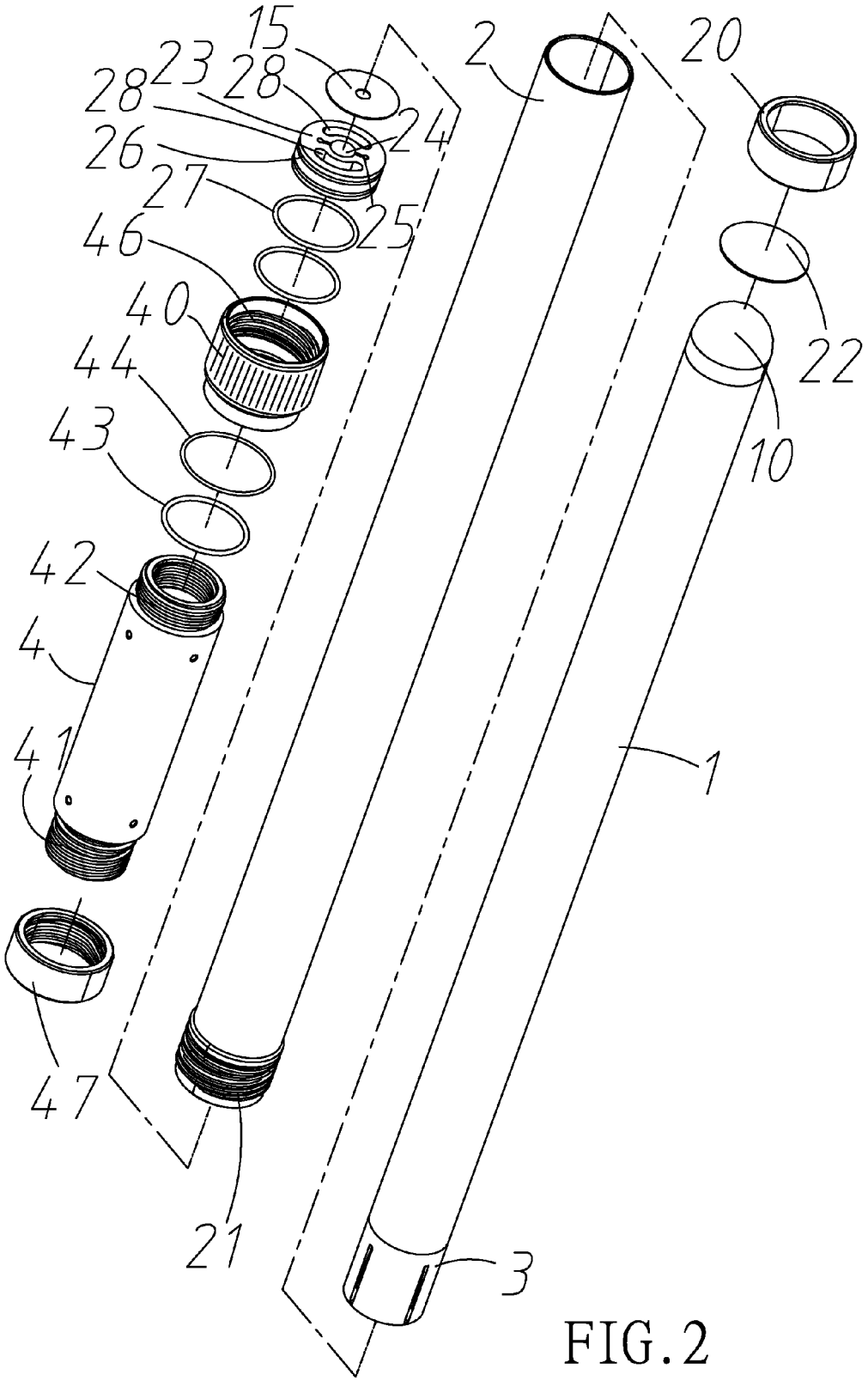
FIG. 2 is an exploded view of FIG. 1.
Figure 3:
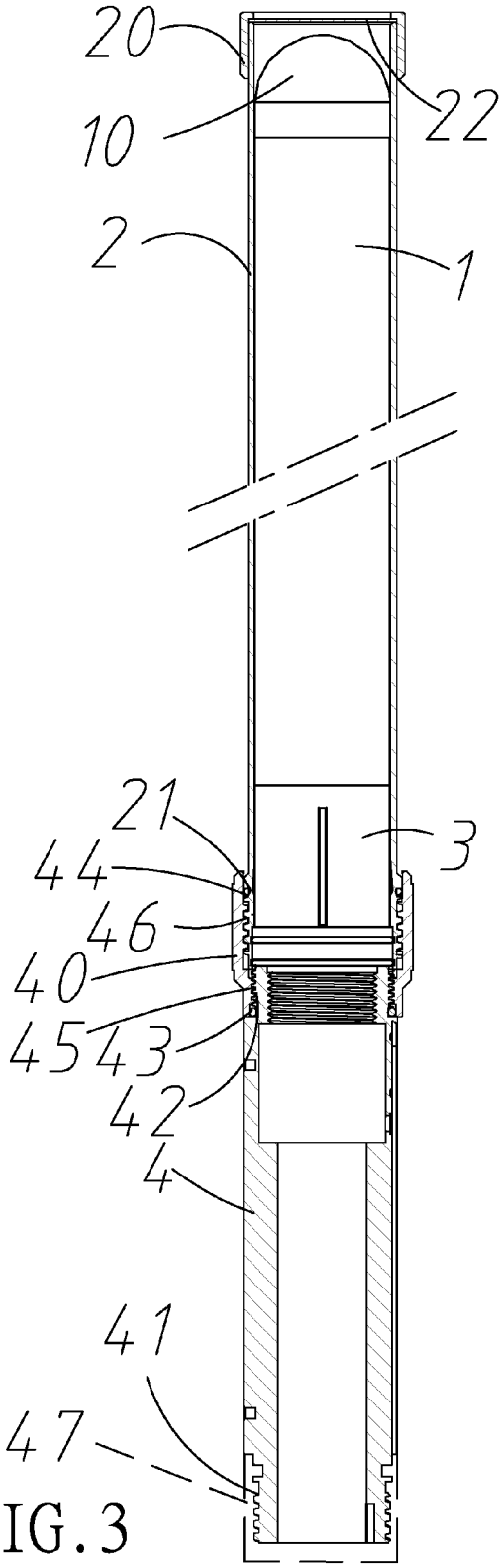
FIG. 3 is a longitudinal sectional view of FIG. 1.
Figure 4:
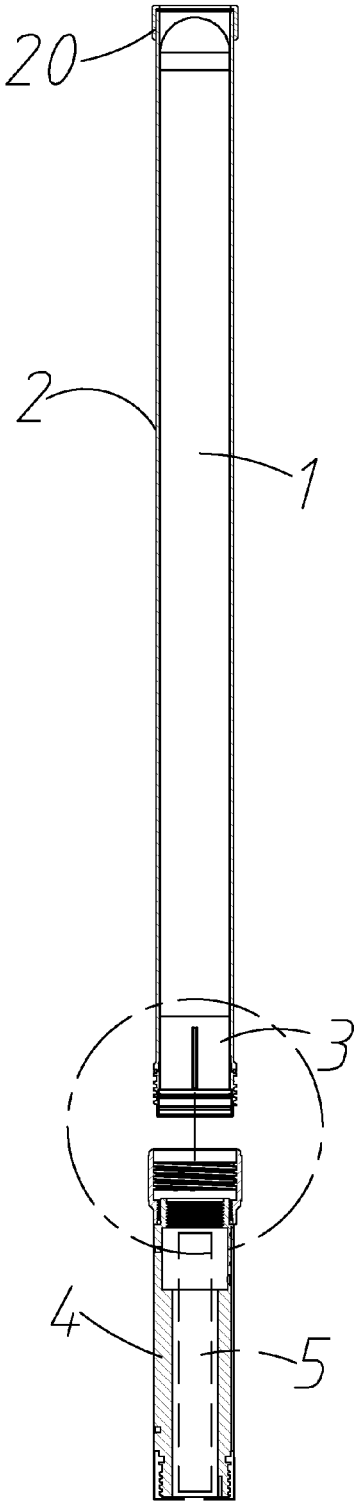
FIG. 4 is a view similar to FIG. 3 with the fin assembly disengaged from the cylinder.
Figure 5:
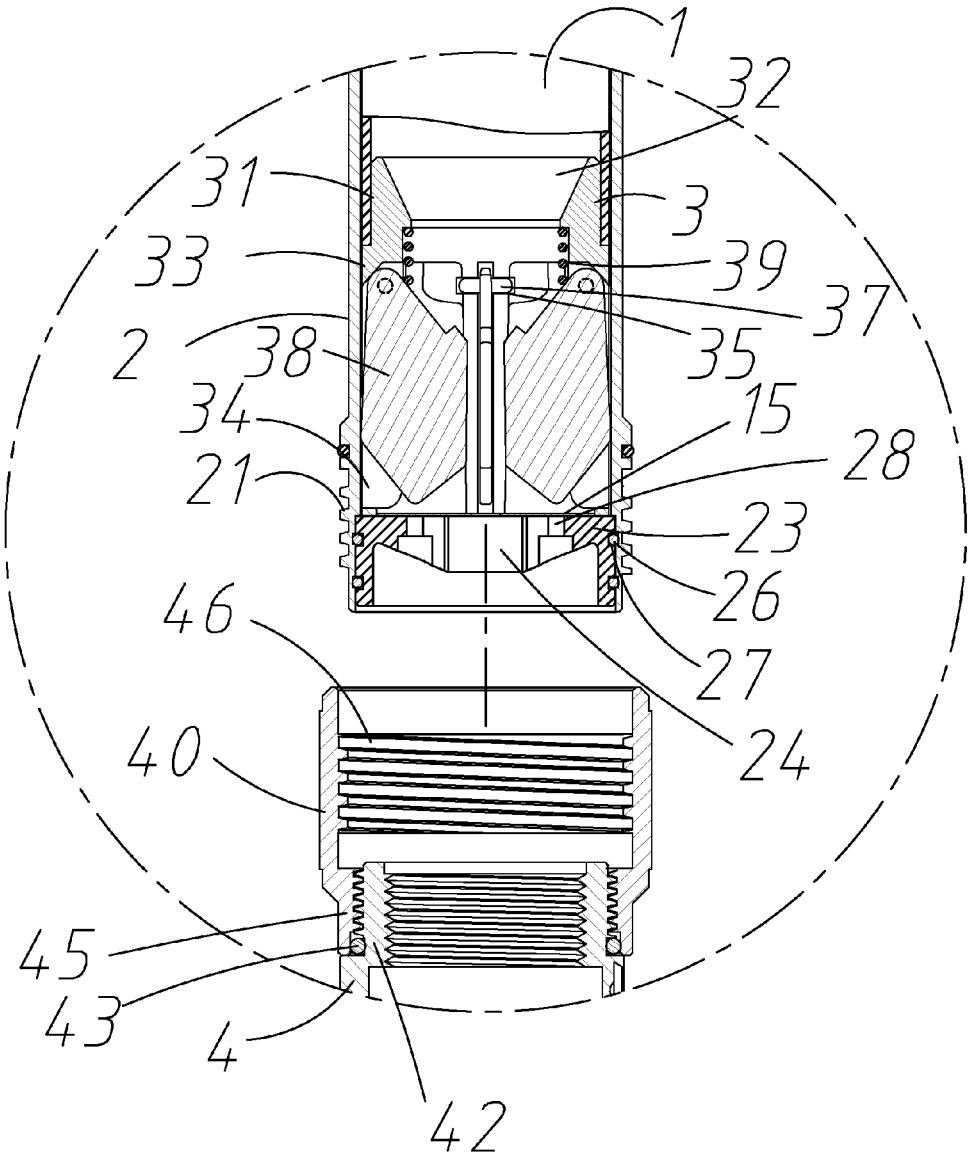
FIG. 5 is a detailed view of the area in a circle of FIG. 4.
Figure 6:
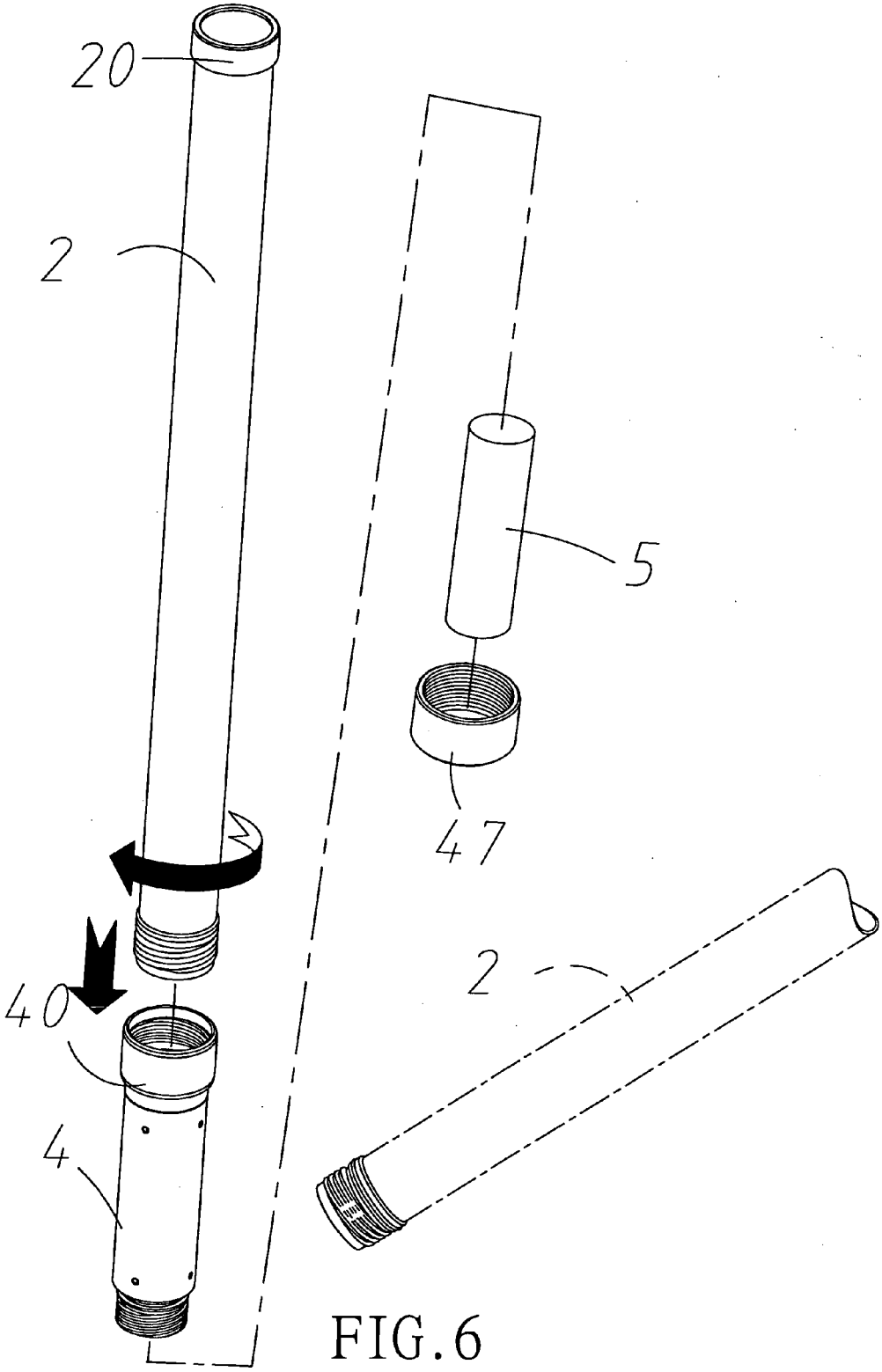
FIG. 6 is an exploded view showing a replacement of the tube.
Figure 7:
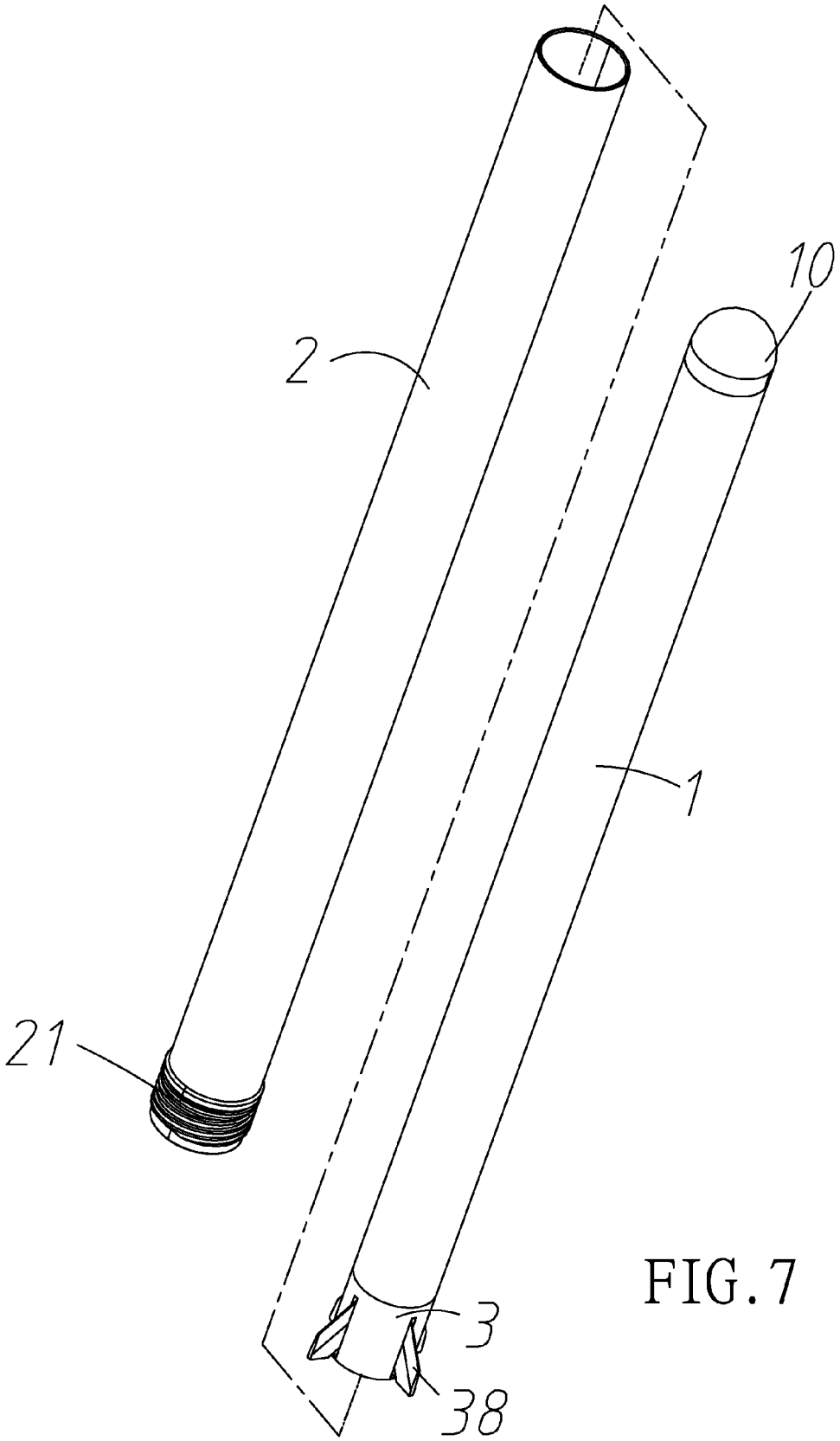
FIG. 7 is an exploded view showing the projectile removed out of the tube with the fins extended.
Figure 8:
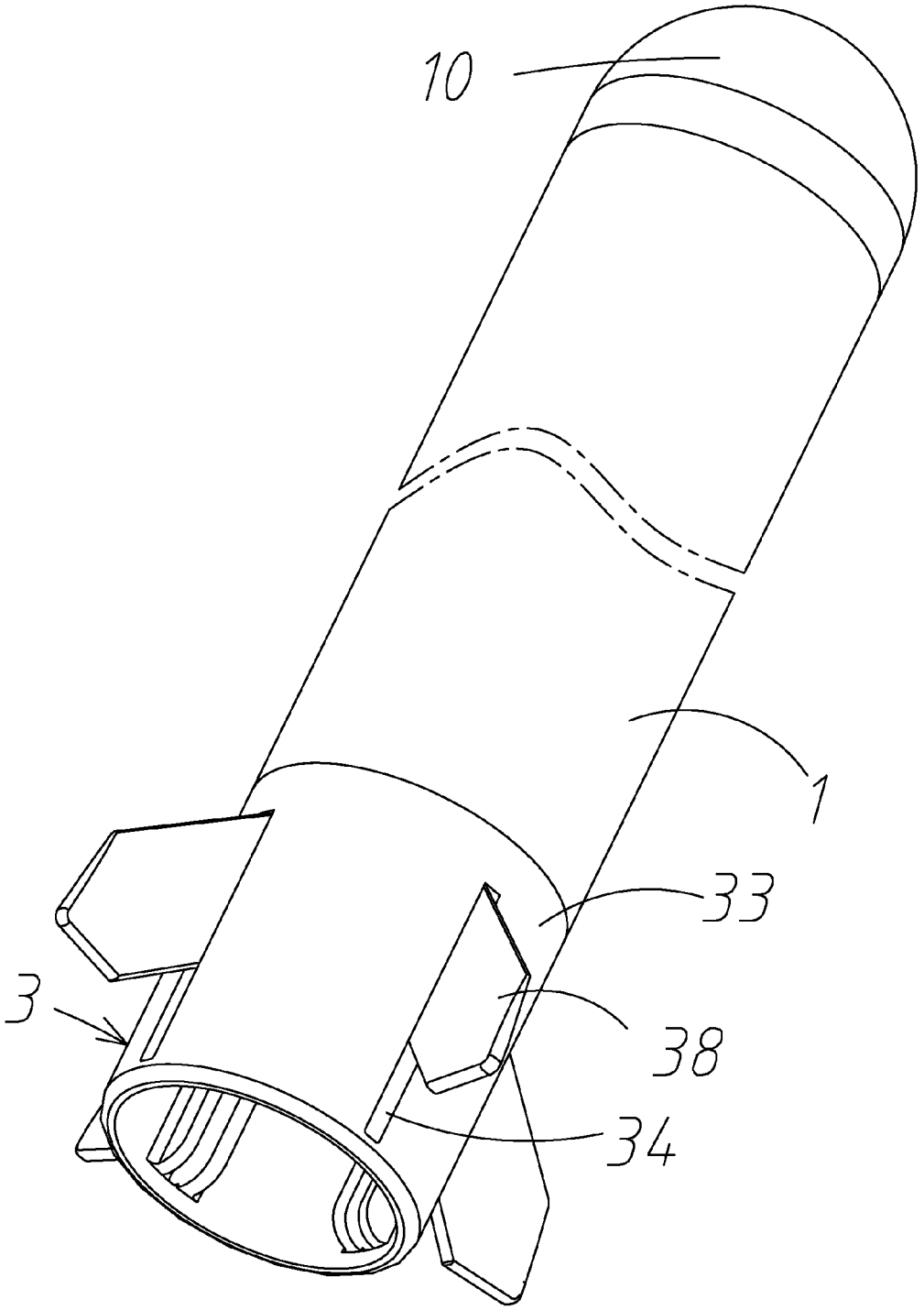
FIG. 8 is a perspective view of the projectile of FIG. 7.
Figure 9:
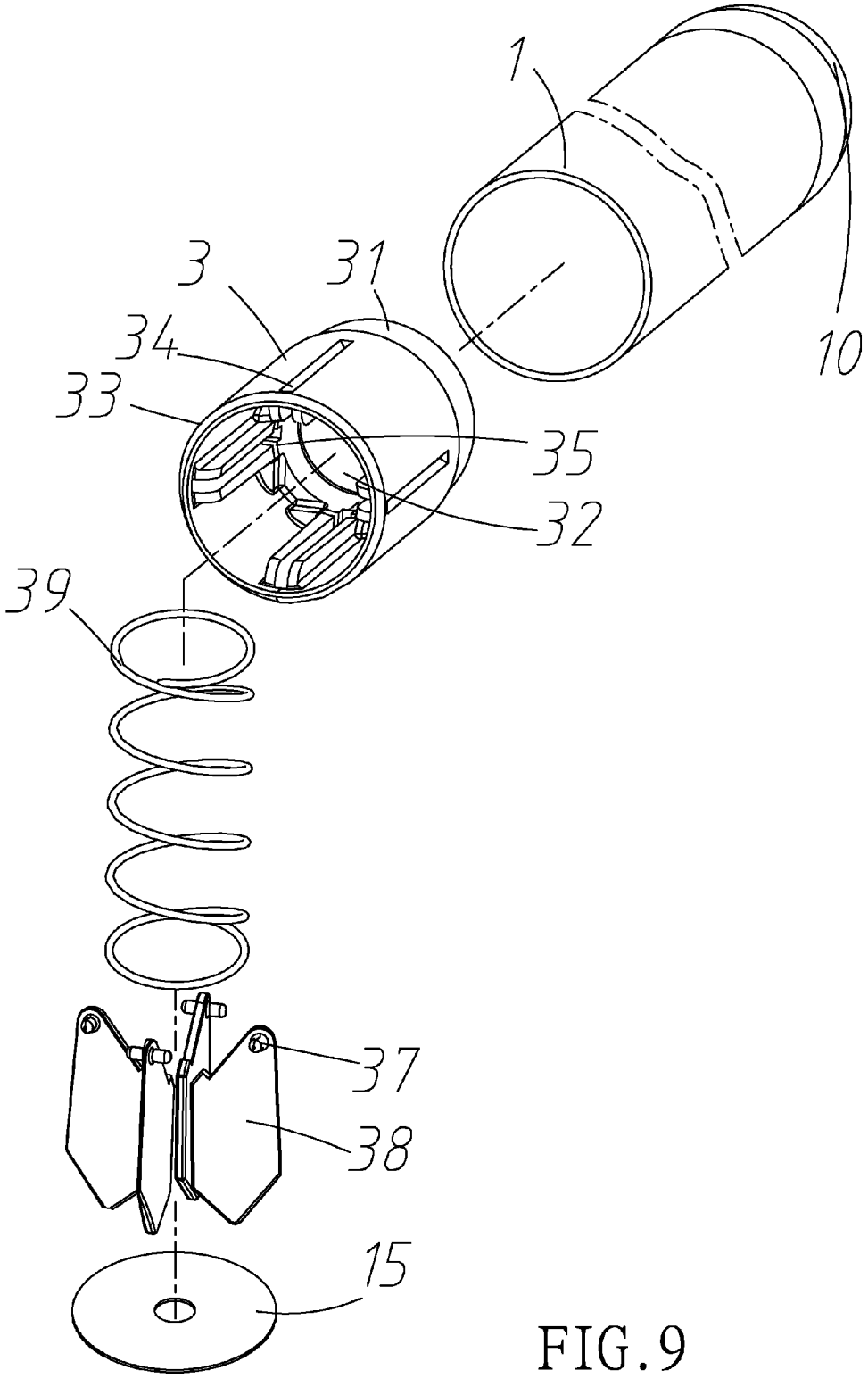
FIG. 9 is an exploded view of the projectile of FIG. 7.
Figure 9A:
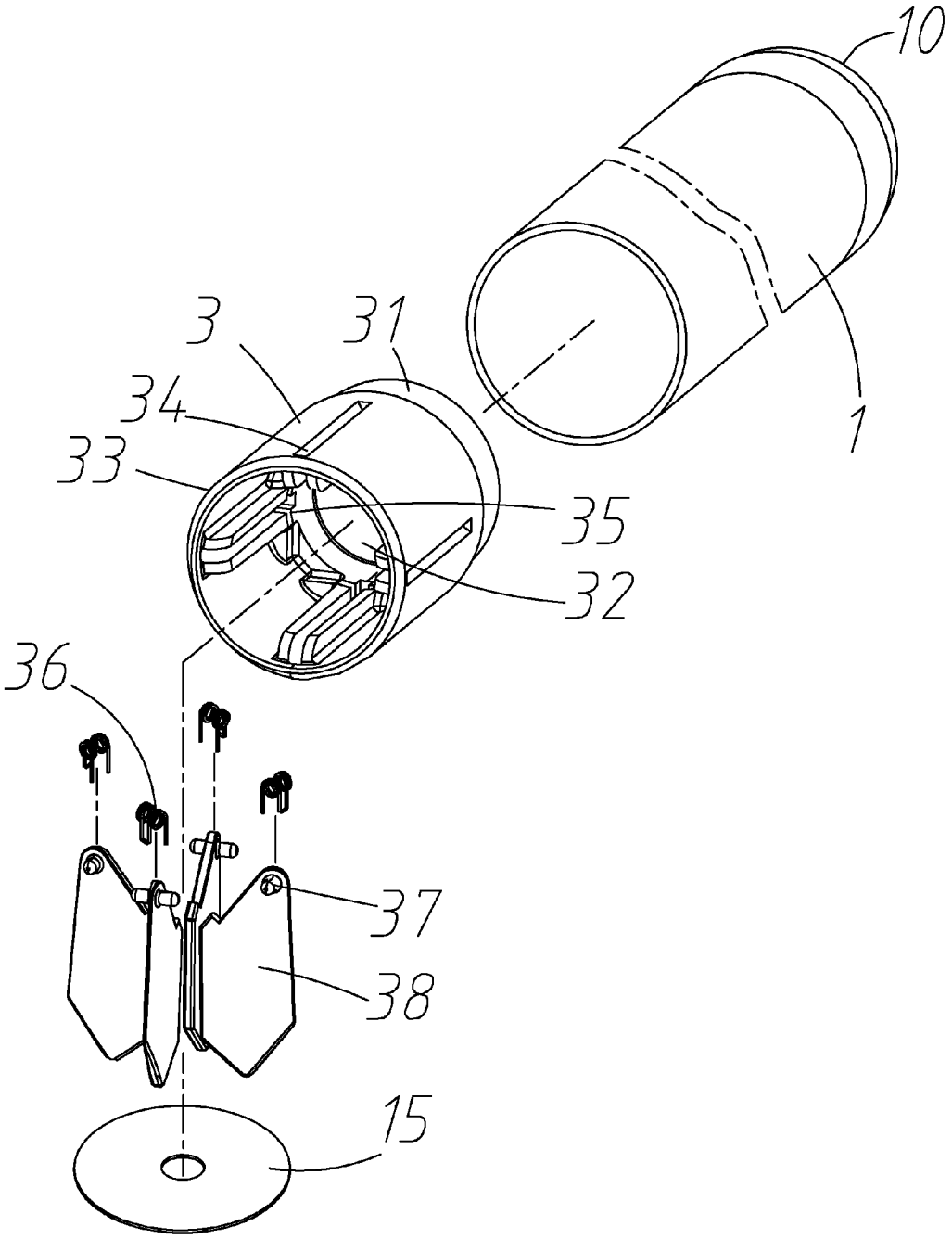
FIG. 9A is a further exploded view of the projectile of FIG. 9.
Figure 10:
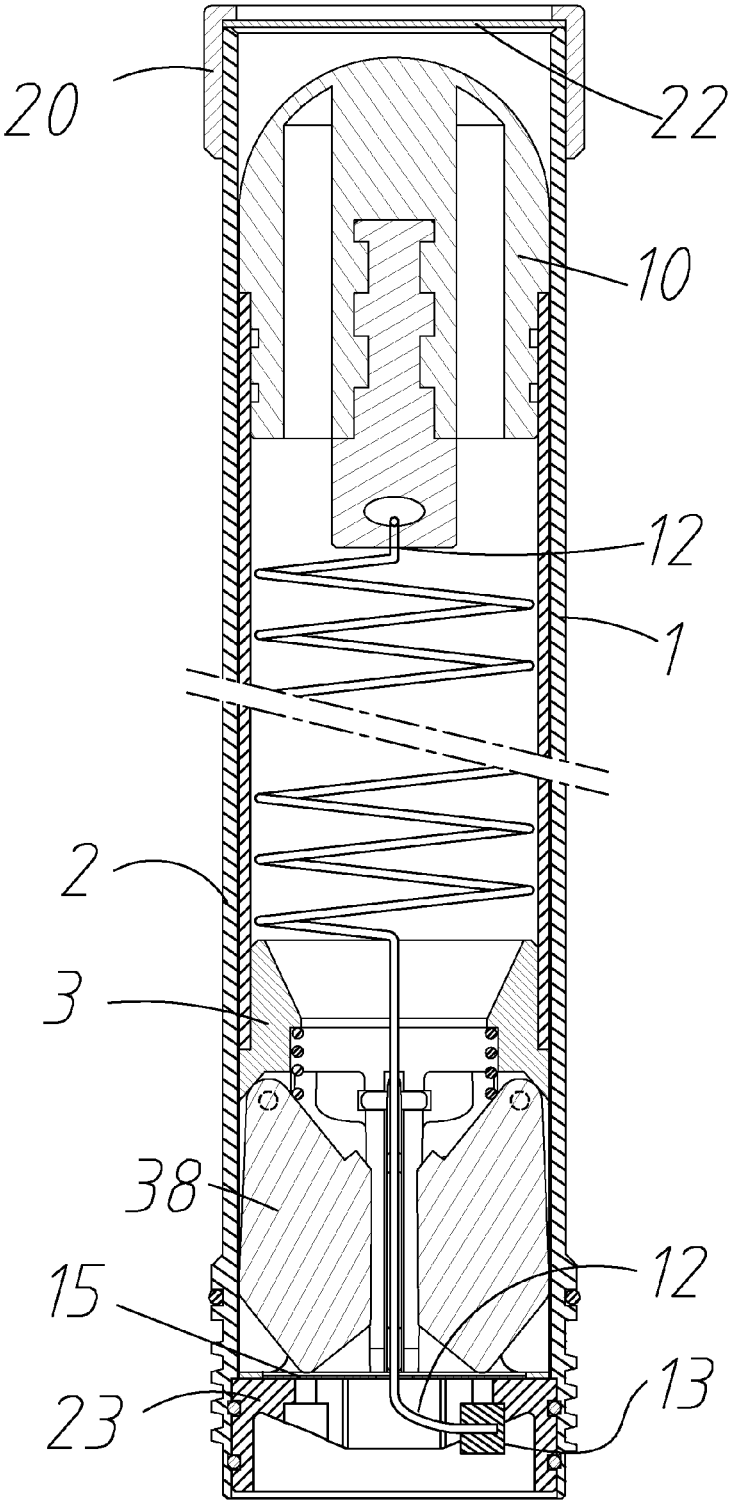
FIG. 10 is a longitudinal sectional view of components from top to bottom of the cylinder of FIG. 1 but with the cylinder removed.
Figure 10A:
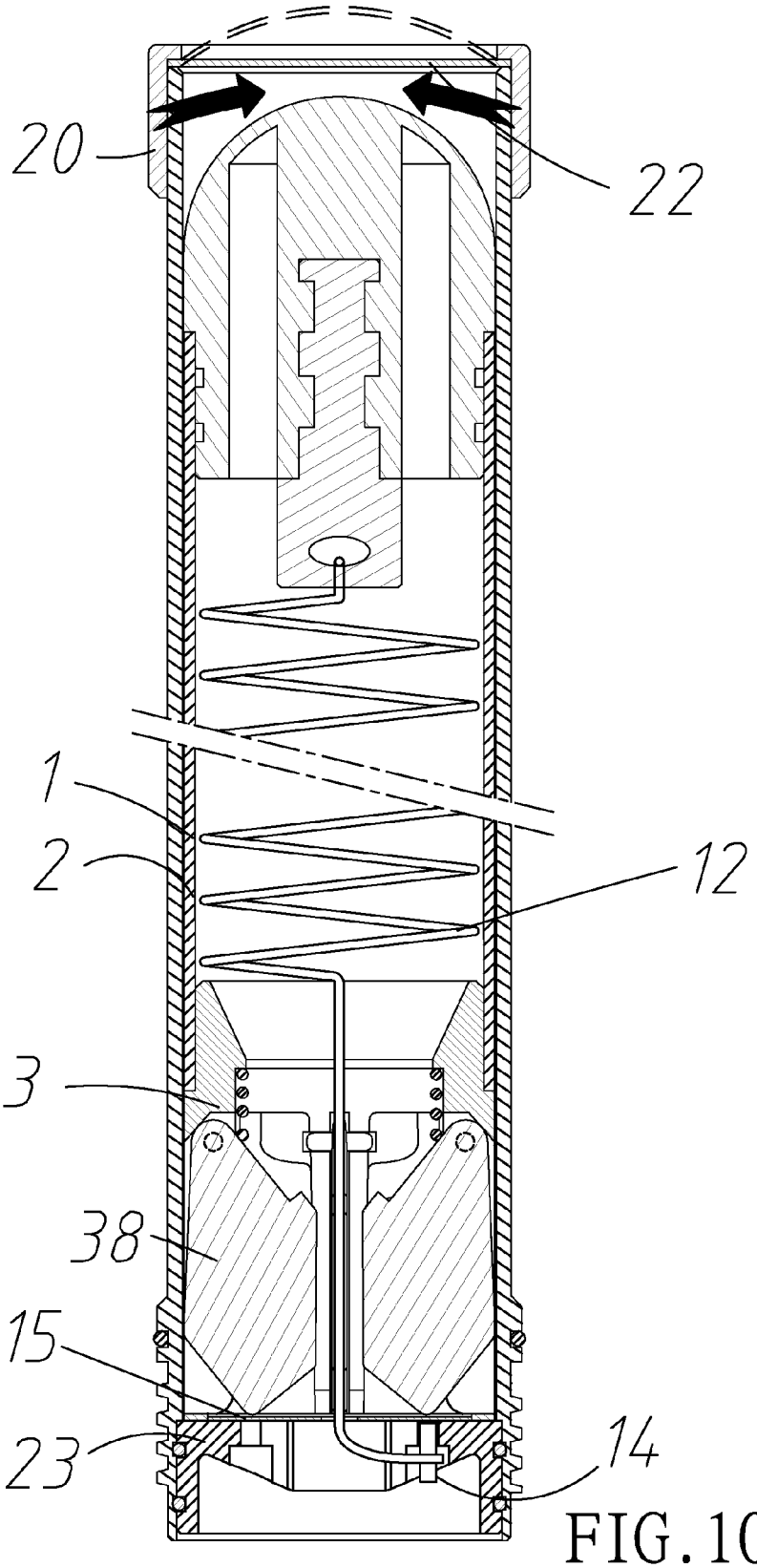
FIG. 10A is a view similar to FIG. 10 showing a fastening member as a replacement of the anchor member of FIG. 10 for fastening the rope.
Figure 10B:
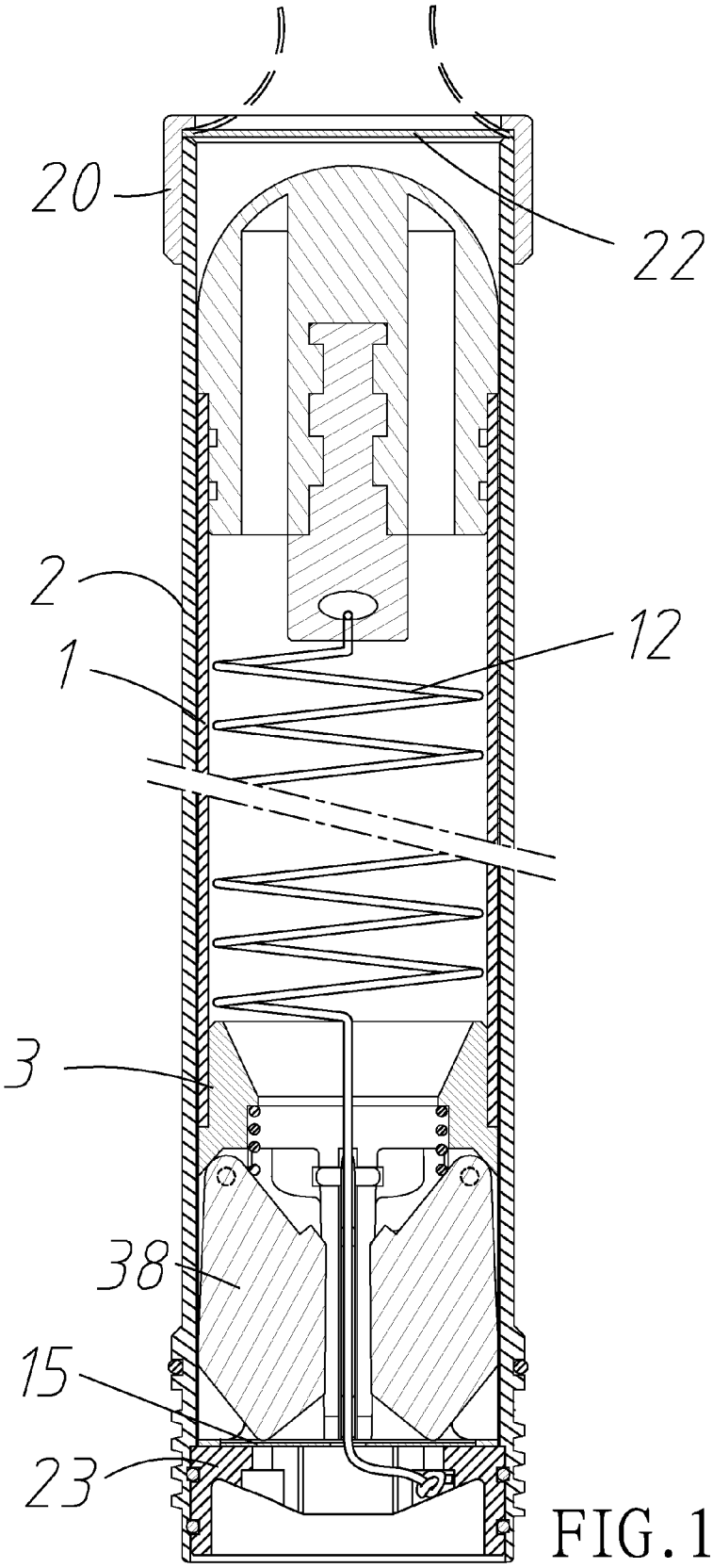
FIG. 10B is a view similar to FIG. 10 showing the other end of the rope being tied into a knot as a replacement of the anchor member of FIG. 10 for fastening purpose.
Figure 11:
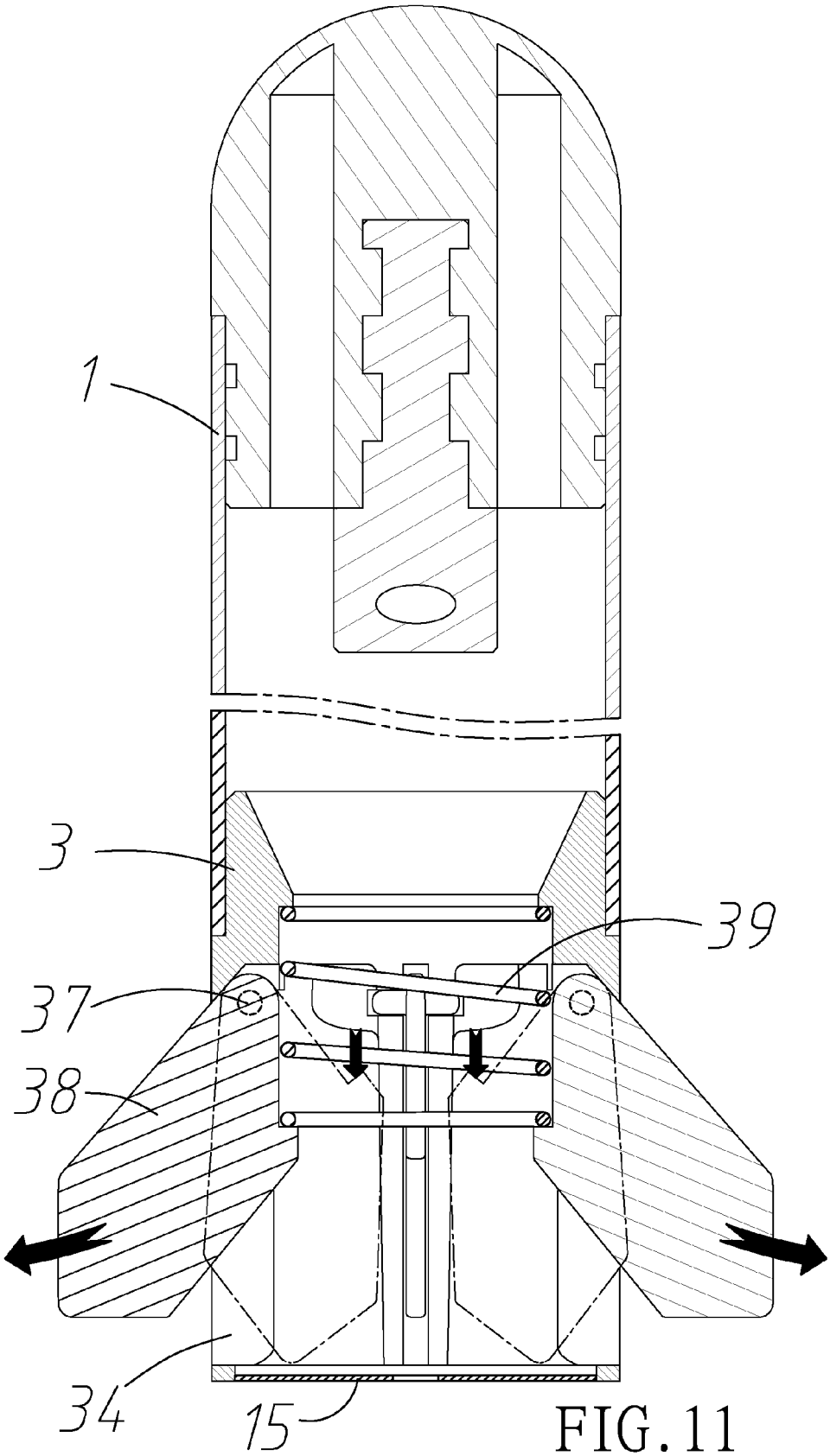
FIG. 11 is a longitudinal sectional view of the projectile of FIG. 8.
Figure 12:
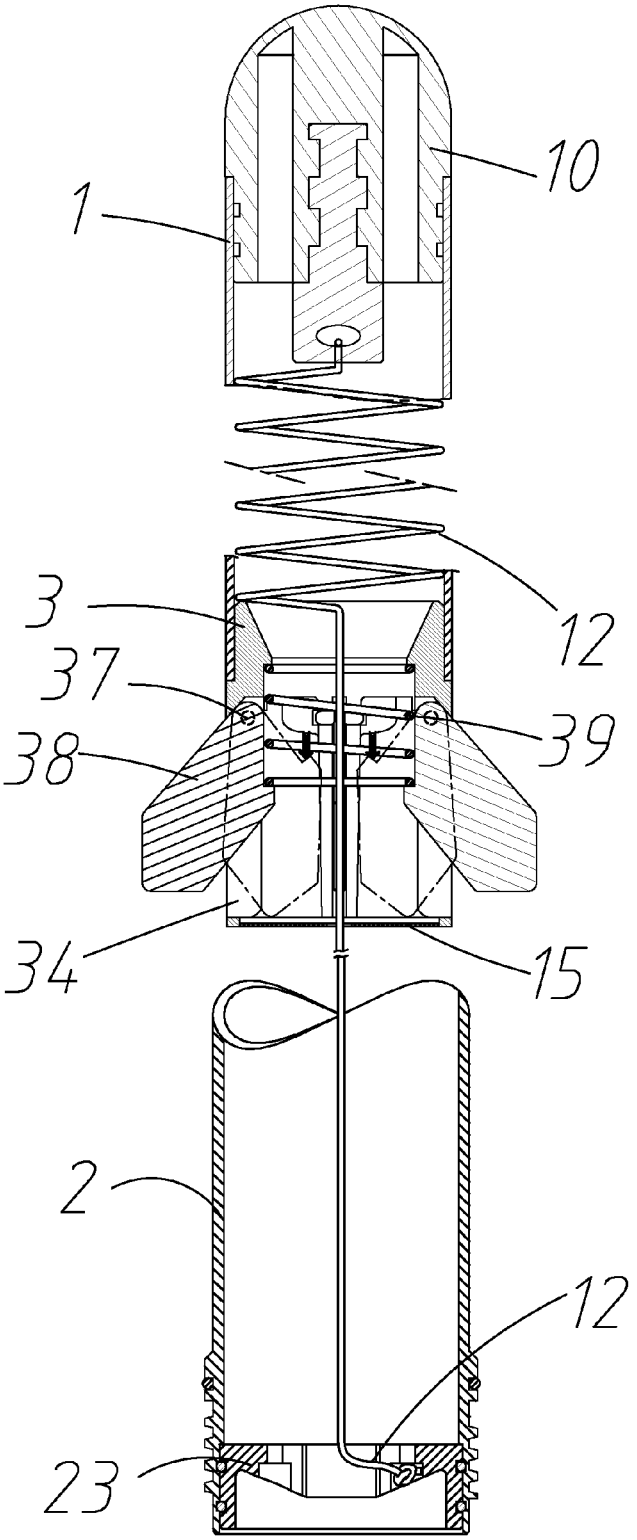
FIG. 12 is an exploded view of FIG. 10 with the diaphragm and the cap removed for illustrating flying of the projectile and the fin assembly.

Referring to FIGS. 1 to 12, a line launching device in accordance with the invention comprises the following components as discussed in detail below.

A projectile 1 and a tube 2 are provided. The projectile 1 comprises an ogive-shaped nose 10 and a rope 12 having one end attached to a bottom of the nose 10. An anchor unit 23 is provided on a lower portion of the tube 2 with the other end of the rope 12 secured thereto. The anchor unit 23 comprises an axial channel 24 for allowing the rope 12 to pass through. Two opposite slits 25 are formed on the mouth of the channel 24. An anchor member 13 is provided adjacent to the channel 24 with the other end of the rope 12 being secured thereto (see FIG. 10). Alternatively, the anchor member 13 is replaced with a fastening member 14 in another configuration. Still alternatively, the anchor member 13 is replaced with a knot formed by tying the other end of the rope 12 in a further configuration.

The short, hollow, cylindrical anchor unit 23 further comprises two annular grooves 26 and two O-rings 27 fitted in the grooves 26 for sealing purpose. The anchor unit 23 further comprises two opposite, curved openings 28 on one surface for allowing gas to pass. The anchor unit 23 is secured to a lower portion of the tube 2. A disc shaped diaphragm 15 having a central opening for allowing the rope 12 to pass is provided on one surface of the anchor unit 23 in covering relationship to the openings 28 and the channel 24. The cylinder 4 comprises a first externally threaded extension 41 at a one end, an internally threaded cup 47 secured to the first externally threaded extension 41, a second externally threaded extension 42 at the other end, and an internally threaded ring 40 having threads 46 in which one portion of the threads 46 is secured to the second externally threaded extension 42 and the other portion thereof is secured to an externally threaded extension 21 at a bottom end of the tube 2. The cylinder 4 further comprises two sealing rings 43, 44 in which one sealing ring 43 is provided between a joining portion of the internally threaded ring 40 and the second externally threaded extension 42, and the other sealing ring 44 is provided between a joining portion of the internally threaded ring 40 and the externally threaded extension 21 all for sealing purposes. A disc shaped diaphragm 22 is sealingly put on one end opening of the tube 2 and a cap 20 is tightly put on the diaphragm 22.

A fin assembly 3 is provided on a bottom of the projectile 1 and comprises a plurality of equally spaced slits (four are shown) 34 on a housing 33, and a plurality of pivotal fins (four are shown) 38 corresponding to the slits 34 respectively. The fins 38 do not project out of the slits 34 prior to launching of the projectile 1 because they are pushed into the projectile 1 by the inner wall of the tube 2 when the projectile 1 is disposed in the tube 2. The fin assembly 3 further comprises a hollow head 33 secured to the housing 33, a passage 32 through the head 33, four wells 35 each formed on an inner surface of the housing 33 and at one end of the slit 34, four pivots 37 disposed in the wells 35, four torsion springs 36 each put on the pivot 37 so that the pivots 37 may make the fins 38 pivotal, and a helical spring 39 anchored in the passage 32 and biased against the fins 38. The rope 12 passes head 33 and the passage 32 to be fastened in the anchor unit 23.

In a rescue operation, a user may remove the cap 20. Next, the user may place a gas canister 5 in the cylinder 4. Next, the user may open the gas canister 5 to cause pressurized gas in the gas canister 5 to strongly flow to the diaphragm 15 to break the diaphragm 15. And in turn, the pressurized gas propels the projectile 1 out of the tube 2 by breaking the diaphragm 22. The fins 38 extend out of the slits 34 due to expansion of the spring 39 after leaving the tube 2. The extended fins 38 can stabilize the flight of the projectile 1. The rope 12 gradually extends out of a rear end of the projectile 1 during the flight of the projectile 1. Preferably, length of the rope 12 is sufficient to allow the projectile 1 to reach a person in need of help.

While the invention has been described in terms of preferred embodiments, those skilled in the art will recognize that the invention can be practiced with modifications within the spirit and scope of the appended claims.

What is claimed is:

1. A pressurized gas propelled line launching device comprising:

a projectile comprising a nose;

a tube for receiving the projectile and comprising an externally threaded bottom, a diaphragm member sealingly put on one end of the tube, and a cap releasably secured to one end of the tube;

a hollow cylinder comprising a first externally threaded extension at one end, an internally threaded cup secured to the first externally threaded extension, a second externally threaded extension at an other end, and an internally threaded ring securing to both the second externally threaded extension and the externally threaded bottom of the tube;

a hollow anchor unit fastened in one end of the tube within the internally threaded ring;

a hollow fin assembly disposed in a bottom of the projectile and comprising a diaphragm element secured to one end of the hollow anchor unit, a housing, a plurality of equally spaced slits on the housing, a plurality of spring actuated pivotal fins, and an internal biasing member biasing against the fins;

a rope having one end attached to a bottom of the nose and an other end fastened in the anchor unit after passing through the projectile and the fin assembly; and a gas canister disposed in the cylinder;

wherein the fins are capable of either projecting out of the slits after the projectile being propelled out of the tube by pressurized gas released out of the gas canister or retracting into the slits in an inoperative position.

* * * * *